US010959028B2

(12) United States Patent
Wurzbacher et al.

(10) Patent No.: US 10,959,028 B2
(45) Date of Patent: Mar. 23, 2021

(54) METHOD FOR OPERATING A HEARING DEVICE AND HEARING DEVICE

(71) Applicant: SIVANTOS PTE. LTD., Singapore (SG)

(72) Inventors: Tobias Wurzbacher, Fuerth (DE); Thomas Kuebert, Lohr (DE); Dirk Mauler, Buckenhof (DE)

(73) Assignee: Sivantos Pte. Ltd., Singapore (SG)

( * ) Notice: Subject to any disclaimer, the term of this patent is extended or adjusted under 35 U.S.C. 154(b) by 30 days.

(21) Appl. No.: 16/403,766

(22) Filed: May 6, 2019

(65) Prior Publication Data

US 2019/0342676 A1 Nov. 7, 2019

(30) Foreign Application Priority Data

May 4, 2018 (DE) ..... 10 2018 206 979.4

(51) Int. Cl.
*H04R 25/00* (2006.01)

(52) U.S. Cl.
CPC ..... *H04R 25/505* (2013.01); *H04R 2225/41* (2013.01)

(58) Field of Classification Search
CPC ..... H04R 25/505; H04R 2225/41
USPC ..... 381/314
See application file for complete search history.

(56) References Cited

U.S. PATENT DOCUMENTS 8,867,763 B2 10/2014 Bouse
8,873,781 B2 10/2014 Hannemann et al.
10,097,935 B2 10/2018 Mauler et al.
10,123,134 B2 11/2018 Jensen et al.
10,142,744 B2 11/2018 Mauler
2011/0317858 A1 12/2011 Cheung
(Continued)

FOREIGN PATENT DOCUMENTS

CN 102761815 A 10/2012
CN 103339965 A 10/2013
CN 103475974 A 12/2013
(Continued)

OTHER PUBLICATIONS

Nesti Alessandro et al.: "Human discrimination of head-centred visual-inertial yaw rotations", Experimental Brain Research, Springer International, DE, vol. 233, No. 12, Aug. 30, 2015 (Aug. 30, 2015) pp. 3553-3564, XP035868321, ISSN: 0014-4819,DOI: 10.1007/s00221-015-4426-2.
(Continued)

*Primary Examiner* — Sean H Nguyen
(74) *Attorney, Agent, or Firm* — Laurence A. Greenberg; Werner H. Sterner; Ralph E. Locher

(57) ABSTRACT

A hearing device has an acceleration sensor that is positioned on the head of a hearing device wearer in the intended worn state, is configured for measurement in two mutually orthogonal measurement axes and is operated by virtue of at least one main feature related to an acceleration directed tangentially in relation to the head being derived from an acceleration signal of the acceleration sensor. The at least one main feature is used to ascertain a presence of a yaw movement of the head by taking into consideration at least one prescribed criterion, derivable from the acceleration signal itself, beyond the presence of an acceleration value of the tangentially directed acceleration that is indicative of a movement.

17 Claims, 5 Drawing Sheets

(56) References Cited

U.S. PATENT DOCUMENTS

| | | | | |
|---|---|---|---|---|
| 2015/0003651 | A1 | 1/2015 | Han et al. | |
| 2015/0230036 | A1* | 8/2015 | Pedersen ..... | H04R 25/305 381/330 |

FOREIGN PATENT DOCUMENTS

| | | | |
|---|---|---|---|
| CN | 107277725 | A | 10/2017 |
| DE | 102015219572 | A1 | 4/2017 |
| DE | 102016205728 | B3 | 7/2017 |
| EP | 2928210 | A1 | 10/2015 |
| EP | 3154277 | A1 | 4/2017 |

OTHER PUBLICATIONS

Keshner E. A. et al.: "Characterizing Head Motion in 3 Planes during Combined Visual and Base of Support Disturbances in Healthy and Visually Sensitive Subjects", Gait Posture Jul. 2008 (Jul. 1, 2008), vol. 28, No. 1, pp. 127-134, XP022686191, ISSN: 0966-6362, DOI: 10.1016/j.gaitpost.2007.11.003.

Aguilar M. et al.: "Prediction of Pitch and Yaw Head Movements via Recurrent Neural Networks",IJCN 2003, Proceedings of the International Joint Conference on Neural Networks 2003, Portland, OR, Jul. 20-24, 2003, International Joint Conference on Neural Networks, New York, NY: IEEE, US, vol. 4, Jul. 20, 2003 (Jul. 20, 2003), pp. 2813-2818, XP010652922, DOI: 10.1109/IJCNN.2003.1224017, ISBN: 978-0-7803-7898-8.

* cited by examiner

METHOD FOR OPERATING A HEARING DEVICE AND HEARING DEVICE

CROSS-REFERENCE TO RELATED APPLICATION

This application claims the priority, under 35 U.S.C. § 119, of German application DE 10 2018 206 979.4, filed May 4, 2018; the prior application is herewith incorporated by reference in its entirety.

BACKGROUND OF THE INVENTION

Field of the Invention

The invention relates to a method for operating a hearing device and to a hearing device that is in particular configured for performing the method.

Hearing devices, in particular in the form of hearing aids, are used by people with a hearing loss to at least partially compensate for the hearing loss. To that end, standard hearing devices regularly include at least one microphone for capturing sounds from the surroundings and a signal processing processor used to process the captured sounds and in particular to amplify and/or attenuate them (in particular in a frequency-specific manner) on the basis of the individual hearing loss. The processed microphone signals are forwarded by the signal processing processor to an output transducer—usually in the form of a loudspeaker—for output to the ear of the respective hearing device wearer. Depending on the type of hearing loss, the output transducers used are so-called bone conduction earphones or cochlea implants for mechanical or electrical stimulation of the ear. The term hearing device also covers other devices, however, such as for example headphones, so-called tinnitus maskers or headsets.

In particular hearing aids frequently have a so-called classifier, which is used to infer particular, predefined "hearing situations," in particular on the basis of the captured sounds. The detected hearing situation is then taken as a basis for altering the signal processing. Since the hearing loss which is present frequently means that the speech comprehension of the hearing device wearer is impaired, the (signal processing) algorithms stored in the signal processing processor are for the most part geared to bringing out the speech utterances of third parties in the captured microphone signals and reproducing them for the respective hearing device wearer in as comprehensible a form as possible. A voice recognition algorithm is frequently executed in the classifier for the purpose of detecting a conversation situation. However, such an algorithm becomes inaccurate in situations in which several people are speaking in the immediate surroundings of the hearing device wearer but not all are taking part in the same conversation. In that case, acoustic identification of the people taking part in the same conversation is regularly hampered.

SUMMARY OF THE INVENTION

It is accordingly an object of the invention to provide a method for operating a hearing device and a hearing device, which overcome the hereinafore-mentioned disadvantages of the heretofore-known methods and devices of this general type and which allow improved operation of a hearing device.

With the foregoing and other objects in view there is provided, in accordance with the invention, a method for operating a hearing device that has an acceleration sensor that is positioned on the head of a hearing device wearer in the intended worn state and that is configured for measurement in two mutually orthogonal measurement axes, wherein the method includes:

at least one main feature related to an acceleration directed tangentially in relation to the head being derived from an acceleration signal of the acceleration sensor, and the at least one main feature being used to ascertain a presence of a yaw movement of the head by taking into consideration at least one prescribed criterion, beyond the presence of an acceleration value of the tangentially directed acceleration that is indicative of a movement, that is derivable from the acceleration signal itself.

The method according to the invention is used for operating a hearing device that has (preferably only) an acceleration sensor. This acceleration sensor is in this case positioned on the head of a hearing device wearer in the intended worn state. Further, the acceleration sensor is configured for measurement in at least two mutually orthogonal measurement axes (also referred to as "measuring directions"). The method involves at least one main feature related to an acceleration that is directed tangentially (and preferably approximately horizontally) in relation to the head of the hearing device wearer being derived from an acceleration signal of the acceleration sensor. The main feature or the respective main feature is subsequently used to ascertain a presence of a yaw movement of the head by taking into consideration at least one prescribed criterion, derivable from the acceleration signal itself, beyond the presence of an acceleration value of the tangentially directed acceleration that is indicative of a movement.

"Relating to the acceleration directed tangentially in relation to the head of the hearing device wearer" is understood in this case and below to mean that the main feature directly reproduces this tangentially directed acceleration, or that the main feature contains at least information about that acceleration.

"Yaw movement" is understood in this case and below to mean in particular a rotational movement of the head about a vertical axis (which preferably at least approximately coincides with the vertical). Further terms used in this case and below for fundamental movements of the head are in particular "nodding" or "noding movement" for a movement directed upward and downward about a "nod axis" that is preferably horizontal and in particular connects the ears of the hearing device wearer, and "rolling" or "rolling movement" for a sideways directed inclination or tilting of the head about a "roll axis" that is preferably horizontal and oriented in particular in the neutral line of vision (also referred to as the "zero degree line of vision").

"Acceleration sensor" is understood in this case and below to mean in particular a sensor in which sensor elements for measurement in the at least two measurement axes (that is to say for two-dimensional measurement), preferably in three mutually orthogonal measurement axes (three-dimensional measurement), are integrated. Therefore, such an acceleration sensor is preferably a self-contained assembly configured for connection to an evaluation unit.

According to the invention, a yaw movement is thus preferably not inferred just when an acceleration directed tangentially in relation to the head can be read from the acceleration signal, but rather only when the presence of the yaw movement is inferred by taking into consideration the at least one additional criterion. In this case, the probability of there actually being a yaw movement is therefore increased. Misinterpretations of the acceleration signal can therefore be avoided or at least reduced. In addition, it is advantageously possible to use only one (single) acceleration sensor for detecting the yaw movement, which means that the use of conventionally used measuring systems, which use multiple sensors, for example a combination of acceleration sensors with gyroscopes and/or magnetic field sensors (also known as "inertial measuring units"), and the associated comparatively high power consumption can be dispensed with. In addition, the detected yaw movement can be used to assist the analysis of hearing situations.

In one expedient method variant, the main feature used is a time characteristic of the tangentially directed acceleration (subsequently also referred to as "tangential acceleration" for short). In this case, the prescribed criterion used and therefore considered is whether the time characteristic of the tangential acceleration has two oppositely directed local extremes (that is say for example a local maximum and a local minimum) in succession within a prescribed movement time window. In particular, consideration is given in this case to whether the tangential acceleration assumes values having opposite arithmetic signs in the time characteristic at these two extremes. This is based on the insight that, when the head yaws, the tangential acceleration initially indicates an "actual" acceleration and subsequently indicates a "negative" acceleration (namely when the head is slowed down) with a respective associated swing (the respective extreme) in the time characteristic. In particular on the basis of the orientation of the measurement axis associated with the tangential direction relative to the actual direction of movement, the tangential acceleration therefore assumes for example initially positive values and "changes" to negative values when the head is slowed down. When the head yaws in the opposite direction, the values of the tangential acceleration accordingly change from negative to positive. The movement time window in this method variant preferably matches the duration of a—in particular in the case of a group conversation—standard rotational head movement and preferably has values of between 0.25 and 2 or 1.5 seconds, in particular from 0.5 to 1 second. Preferably, the movement time window is "opened" (i.e. the monitoring thereof is started) if a sufficiently significant change in the values of the tangential acceleration is detected. The movement time window advantageously achieves (temporal) limiting of consideration of the main feature, in particular of the time characteristic of the tangential acceleration, which means that "acceleration events" that, due to their comparatively long duration, have a high probability of not being associable with a head rotation (that is to say with yawing) are ignored.

An extreme in the time characteristic is inferred in this case and below in particular only if the underlying change in the time characteristic can be distinguished from a standard measured value fluctuation, for example noise, or from slight movements (that regularly do not cause sufficiently significant changes in the time characteristic). By way of example, a threshold value comparison is performed for this purpose.

In an expedient development of the method variant described above, one supplementary feature derived from the acceleration signal is a time characteristic of an acceleration radially (and in particular also horizontally) directed in particular in relation to a yaw axis of the head of the hearing device wearer (which regularly at least approximately coincides with the vertical). The prescribed criterion used in this case is in particular whether the time characteristic of the radially directed acceleration (subsequently: "radial acceleration" for short) assumes a local extreme within the prescribed movement time window (which is described above). That is to say that in this method variant there are two criteria under consideration, namely whether the tangential acceleration indicates the acceleration described above and the slowing down and whether the radial acceleration likewise indicates an acceleration. From such an, actually occurring, radial acceleration, which is in particular linked to the centrifugal force that inevitably occurs during a yaw movement, it is advantageously possible—in particular in conjunction with the two local extremes of the tangential acceleration—to derive a comparatively high probability of there being not only a rectilinear movement along one of the measurement axes but also additionally a yaw movement of the head.

In a further expedient method variant—in addition or as an alternative to the method variants described above—the time characteristic of the tangential and possibly also the radial acceleration is used to ascertain a movement intensity. The prescribed criterion used in this case is a level of the movement intensity—preferably the magnitude of the ascertained value of the movement intensity. By way of example, a threshold value comparison is performed for this purpose in order to compare the ascertained value of the movement intensity with a prescribed threshold value. The presence of the yaw movement is therefore inferred in this case in particular if the movement intensity has a specific, in particular prescribed, level. Optionally, the presence of the yaw movement is not inferred in this case if the movement intensity is distinctly above and/or below the prescribed (expected) level. In particular, in this method variant, a probability of the presence of the yaw movement is ascertained having a probability value which decreases the more the movement intensity differs from the expected level (in particular is above or below it).

Preferably, the measure ascertained for the movement intensity in this case is a movement duration and/or a total energy or mean energy contained in the tangential and radial acceleration—in particular in the respective measured value characteristic.

In a further expedient method variant, the main feature ascertained is a correlation coefficient between a time derivative of the tangential acceleration and the radial acceleration. In particular, the tangential acceleration (preferably the time characteristic thereof) is thus initially derived on the basis of time and subsequently correlated with the radial acceleration (preferably with the time characteristic thereof). The prescribed criterion used in this case is the level—i.e. in particular the absolute value magnitude of the value—of the correlation coefficient. By way of example, a threshold value comparison of the correlation coefficient with an in particular prescribed threshold value is effected in this case too. This approach is based on the insight that a yaw movement of the head results in the change in the tangential acceleration (that is to say the time derivative)—regularly—assuming a local extreme, the timing of which closely coincides with that of the local extreme of the radial acceleration or even overlaps it. Therefore, this correlation coefficient is advantageously a comparatively easily checkable indication of the presence of a yaw movement. A high absolute value of the correlation coefficient can therefore advantageously easily be used to infer a high probability of the presence of the yaw movement. By contrast, a comparatively low level of the correlation coefficient (for example less than 0.5 or less than 0.3) indicates comparatively uncoordinated or aimless head movements or an unmoving head.

In an advantageous development of the method variant described above, the correlation coefficient, preferably the arithmetic sign, is used to ascertain a yaw direction. That is to say that the arithmetic sign of the ascertained correlation coefficient is used as an indicator of the direction in which the hearing device wearer turns his or her head. The reason for this is in particular that the acceleration sensor used has a positive and a negative measurement direction for each measurement axis. If for example the acceleration sensor is disposed on the left ear of the hearing device wearer in the intended worn state of the hearing device and the measurement axis associated with the tangential acceleration has its positive direction pointing in the line of vision of the hearing device wearer, the time characteristic of the tangential acceleration will initially indicate negative values for a yaw movement to the left (despite the actual acceleration). Accordingly conversely, the time characteristic will initially assume positive values for a yaw movement to the right. Therefore, in an optional method variant, just one main feature is sufficient in order to be able to infer the presence of the yaw movement and also the yaw direction thereof in particular in a robust manner, i.e. with comparatively low susceptibility to error.

In a further expedient method variant—in addition or as an alternative to the method variants described above—the main feature used is a curve of a graph in which the tangential acceleration is plotted against the radial acceleration. That is to say that this curve is determined initially. The prescribed criterion used in this case is in particular the geometric shape of this curve. Such a curve advantageously already contains the information of the two measurement axes relevant to a yaw movement. Optionally, ascertainment of additional features can therefore be dispensed with.

As a particular preference, the prescribed criterion checked in the case described above is whether the above-described curve of the graph approximates an ellipsoidal shape. Since, as described above, a yaw movement results in measured values that change over time being capturable both for the tangential and for the radial acceleration, the temporally successive measured values of the acceleration sensor are on a path curved in one direction in the graph described above. A conscious and "ideal" yaw movement of the head—i.e. a uniform movement running exactly in a, in particular horizontally disposed, plane defined by the two measurement axes associated with the tangential and the radial acceleration—would result in the measured values of the acceleration sensor describing a rounded, half-moon-like shape. An anatomically dependent "inclined position," present for the most part, of the yaw plane of the head and other influences leading to a for the most part steady-state offset (for example gravitational pull) mean that the curve frequently has at least an oval, possibly "open" (i.e. the start and the end do not coincide) shape for a conscious yaw movement, however. By contrast, a nondirectional head movement will result in the curve described above having other shapes, for example a zigzag-like characteristic (that is to say with changing directions of curvature). Ellipsoidal is therefore understood in this case and below to mean in particular that the curve has a shape that is curved and approximately closed (i.e. in particular open with a slight offset in comparison with the curve length) in one direction of rotation or is at least made up of multiple curve sections that have such curvature and possibly connect rectilinear sections.

In a preferred development, the direction of rotation of the curve described above—which in particular can be read from the chronological order of the individual measured values—is used to ascertain the yaw direction. Therefore, in an optional method variant, just one main feature is sufficient in this case too to determine the presence of the yaw movement and the yaw direction thereof in a particularly robust manner, i.e. with comparatively little susceptibility to error.

In one preferred method variant, the main feature or the respective main feature and the possibly additionally ascertained supplementary feature are ascertained in a moving manner over a time window that overlaps a subsequent, in particular simultaneous, time window. The length of the respective time window in this case is approximately 0.25 to 2 seconds, in particular approximately 0.5 to 1.5 seconds. Preferably, this involves the use of an overlap of approximately 0.25-1, in particular up to 0.75, seconds between the subsequent time window and the preceding time window. The length of the (respective) time window is obtained in this case from the insight that a standard, conscious yaw movement of the head lasts for approximately 0.5 seconds to 1 second. In particular, in this method variant, the acceleration sensor uses a frequency of approximately 10-60 hertz, preferably of approximately 15-20 hertz, to output two or three measured values in each case that are associated with the two or three measurement axes. These measured value groups (i.e. the respective two or three measured values) are in particular buffer-stored in a buffer store that can hold eight of these measured value groups. A so-called "update rate" of the buffer store is preferably approximately 2 hertz in this case. This means that determination of the main feature or the respective main feature continuously over time can be dispensed with. By way of example, if no change in one of the measured values is detected within this time window, it is possible for the main feature or the respective main feature not to be determined. This can advantageously save computing effort.

In a further preferred method variant, a value of a yaw angle is ascertained from the acceleration signal only if the presence of the yaw movement is detected in particular according to one or more of the method variants described above. This is firstly expedient for saving computing effort. Secondly, it means that it is advantageously possible to prevent in particular steady-state influences or slowly changing interference variables (for example the earth's gravitational field, an inclined head posture or the like) from affecting ascertainment of the yaw angle. This is because, preferably, the yaw angle is determined by (twice) integrating the tangential acceleration, in particular the time characteristic thereof, the above-described influences or interference variables being recognized to have a particularly great effect due to the integration, in particular given comparatively long integration periods. As a result of the yaw angle being determined only if there is actually a yaw movement, the temporal length of that section of the time characteristic of the tangential acceleration that is to be integrated can be kept particularly short, which means that the above-described influences have only a slight effect and drifting of the result can be avoided particularly effectively.

In a preferred method variant, constant and/or linear measured value components are filtered out of, i.e. removed from, the acceleration signal, in particular out of/from the tangential and the radial acceleration—optionally also only out of/from the integrated tangential acceleration (in particular the time characteristic thereof). By way of example, in a simple but expedient variant, a high pass filter is used. In a further simple variant, a temporal (in particular moving) average of the measured values associated with the respective measurement axis is subtracted from the individual measured values. As a result, it is a simple matter for steady-state (for example gravitational pull) or only comparatively slowly changing influences captured by the acceleration sensor to be removed or at least reduced. Additionally or alternatively, linear trends are removed from the measured values, in particular from the respective time characteristics or optionally from the integrated tangential acceleration, by virtue of in particular so-called "detrending" being used.

Preferably, in particular the gravitational pull is fundamentally compensated for preferably in the "blank" acceleration signal, in particular by virtue of the acceleration signal being supplied to the high pass filter. This allows the influence of the gravitational pull to be reduced at least to a significant extent. In addition or as an alternative to the high pass filtering, nod and roll angles of the head in relation to the gravitational field are determined. These angles are subsequently used to determine a so-called "direction cosine matrix," through the use of which the present measurement data contained in the acceleration signal (i.e. the measured values associated with the respective measurement axes) are transformed, in particular rotated, by a hearing-device-wearer-specific coordinate system to the "global" coordinate system referenced to the earth. Following this coordinate transformation, the measurement data are purged of the influence of the gravitational field—or at least the remainders thereof that are left after the high pass filtering—and subsequently the measurement data are transformed back to the original coordinate system (i.e. to the coordinate system referenced to the hearing device wearer). This advantageously allows the influence of the gravitational field to be removed at least to a large extent.

Additionally or alternatively, the integrated tangential acceleration is optionally also purged of such (steady-state or slowly changing) influences, for example through the use of "detrending." This variant is based on the consideration that the comparatively short duration of a yaw movement means that the remaining drift is comparatively small or at least is contained as an approximately constant or linear influence within the time window to be considered (which is in particular mapped in the buffer described above). Therefore, the integrated tangential acceleration can easily be purged of these (optionally remaining) constant and/or linear measured value components.

In one expedient method variant, a classification algorithm is applied to the main feature or the respective main feature and possibly the supplementary feature in order to determine the presence or at least probability of the presence of the yaw movement. That is to say that the main feature or the respective main feature and possibly the supplementary feature are supplied to a classification algorithm that is used to perform the above-described consideration with respect to the criteria associated with the respective main feature (and possibly the supplementary feature) being satisfied. Optionally, the classification algorithm is also configured to determine not only the presence of the yaw movement but also the yaw direction (i.e. the direction of rotation when the head yaws), the duration and/or the level of the yaw movement or at least of the head movement. The classification algorithm used in this case is for example a "Gaussian mixture mode model," a neural network, a "support vector machine" or the like. Optionally, a classifier (in which, besides standard classification algorithms, preferably the applicable classification algorithm described above is implemented), which is frequently present in a hearing device anyway, is resorted to in this case. Preferably, the classifier and hence also the classification algorithm are trained for the respective manifestation, indicative of the presence of the yaw movement, of the respective main or supplementary feature (i.e. the respective criterion). Optionally, in particular in the case of the neural network, the classifier is also modeled in a self-learning manner.

In a further expedient method variant, the yaw movement itself, but preferably the ascertained values of the yaw angle covered during the yaw movement, is/are used to ascertain a spatial area of interest of the hearing device wearer. That is to say that over a prescribed period—which is preferably in turn a moving period having a duration of for example 20 seconds to 2 minutes, in particular approximately 30 seconds to 1 minute—the lines of vision, in particular starting from a zero degree line of vision, to which the hearing device wearer turns his or her head are observed. Preferably, this area of interest is ascertained by virtue of the yaw angles (i.e. specifically the individual values) ascertained within the prescribed period being statistically evaluated and in particular a histogram being created. Since people—and hence also the hearing device wearer—usually turn their line of vision to the current area of interest through the use of a head movement (i.e. yawing of the head), it is therefore possible to read from the statistical evaluation, for example the histogram about past yaw movements, an area in which there is or at least was comparatively great interest from the hearing device wearer.

In a particularly expedient method variant, the information about the yaw movement of the head of the hearing device wearer, in particular the spatial area of interest described above, is used for customizing a signal processing algorithm for a conversation situation. By way of example, the yaw movement, in particular the histogram created therefrom, can be used to derive the spatial area of vision in which the current main interest of the hearing device wearer lies and hence also where potential interlocutors are situated. Particularly expediently, this information is used together with the information of an acoustic classifier, i.e. the information of the movement analysis described above (i.e. the ascertainment of the presence of the yaw movement) is combined with that of an acoustic analysis (i.e. of the acoustic classifier), which is also referred to as a "fusion." By way of example, the acoustic classifier is used to fundamentally ascertain the presence of a conversation situation and possibly additionally to ascertain the spatial directions from which relevant acoustic signals (usually voice signals coming from third parties) arrive at the hearing device and hence at the hearing device wearer. The information about the yaw movement of the head is in this case preferably used to further narrow down the spatial area in which the interlocutors of the hearing device wearer have a high probability of being situated. This is particularly expedient, by way of example, for the case in which the hearing device wearer is in an acoustically nonunique conversation situation in which at least two conversations are taking place in parallel, but the hearing device wearer only takes part in one of the two conversations. This arises for example in restaurants, bars or the like, in particular when people on one side of the hearing device wearer are talking to one another but the hearing device wearer speaks only to people in front of him or her or on his or her other side. In this case, it is regularly possible for the acoustic classifier to interpret all arriving voice signals as belonging to the conversation. The yaw movement of the head can therefore be used to ascertain where the hearing device wearer is actually looking, and this can be used to infer which voice signals have a comparatively high probability of not belonging to the conversation.

In an advantageous method variant, the above-described zero degree line of vision of the hearing device wearer is in particular referenced on the basis of a nodding movement of the head, a vertical movement of the hearing device wearer and/or on the basis of a forward movement (optionally detected through the use of a separate "movement classifier") of the hearing device wearer. Such movements derivable from the acceleration signal are used in particular for detecting movements such as for example nodding, drinking, standing up, activities such as tying one's shoe laces, walking, jogging, driving, cycling and the like. This method variant—which is also an actual invention—is based on the insight that in particular movements such as nodding and drinking have a high probability of regularly being effected with the head oriented in the zero degree line of vision even in the case of a group conversation or a lecture situation, in which the hearing device wearer is looking at a board or a screen for comparatively long periods. The referencing serves in this case to avoid or at least compensate for a drift, in particular when creating the histogram described above, that may be caused for example by erroneous nondetection of a yaw movement. In addition, there is a high probability of being able to assume that activities such as standing up and tying one's shoe laces are performed with the head oriented straight. The same applies to the activities such as walking, jogging, driving, cycling and the like, in which the hearing device wearer will have a high probability of turning his head to the side only relatively rarely. Optionally, a "movement classifier" is used for detecting the movements described herein, in particular the activities such as walking, jogging, driving, cycling, tying one's shoe laces, in which in particular the whole body of the hearing device wearer is in motion. That movement classifier is preferably formed by an appropriate classification algorithm that is in turn expediently directed at movements of the whole body of the hearing device wearer.

In a further expedient method variant, the additional criterion used for ascertaining the yaw movement (in particular whether there is one) is an output of the movement classifier described above, in particular directed at the movement of the whole body of the hearing device wearer. As such, it is assumed for example that activities detected through the use of the movement classifier such as for example cycling, driving and jogging result in the probability of the hearing device wearer taking part in a group conversation being comparatively low. These activities are each recognized to take place in comparatively "fast" movement situations in which the hearing device wearer ought to have a comparatively high probability of directing most of his or her (in particular visual) attention forward. The information (output) of the movement classifier can be used in this case to block or at least verify the evaluation of the main features and possibly of the supplementary feature. If the hearing device wearer is at rest, a repeated yaw movement of the head—in particular in the case of an acoustically classified conversation situation—will have a high probability of indicating that the hearing device wearer is taking part in the conversation with several people. The information of the movement classifier can in this case thus likewise be incorporated into the above-described classification algorithm (directed at the yaw movement) and/or into the fusion of the movement and acoustic information, for example.

In a preferred method variant, a configuration of the acceleration sensor in or on the hearing device in such a way that at least one of the measurement axes of the acceleration sensor is at least approximately oriented tangentially in relation to the head, preferably parallel to the natural zero degree line of vision of the hearing device wearer, is used. Preferably, this measurement axis is also oriented horizontally in this case. The two other measurement axes in this case are preferably disposed vertically or horizontally and along the above-described nod axis (with the body posture upright). As a result of this configuration, the individual measured values associated with the measurement axes are advantageously already associated with the tangential and radial accelerations.

In particular if the above-described hearing device is part of a binaural system, the above-described method for detecting the yaw movement and possibly for determining the yaw angle is in each case performed separately—i.e. monoaurally—in each of the two hearing devices, and the two monoaural decisions are subsequently synchronized "binaurally."

In an optional method variant, the two monoaural acceleration signals are combined to form a binaural signal—for example the difference from the two acceleration signals is formed—and the method described above is applied to the binaural sensor signal.

With the objects of the invention in view, there is concomitantly provided a hearing device, having an acceleration sensor that is positioned on the head of a hearing device wearer in the intended worn state and that is configured for measurement in two mutually orthogonal measurement axes, and having a processor that is configured to perform the method.

The hearing device according to the invention includes the (in particular single) acceleration sensor, which is disposed on the head of the hearing device wearer in the intended worn state of the hearing device and is configured for measurement in the at least two, optionally three, measurement axes. In addition, the hearing device includes a (signal processing) processor that is configured—by programming and/or circuitry—to perform the above-described method according to the invention, in particular automatically. Therefore, the processor is configured to derive the at least one main feature linked to the tangential acceleration from the acceleration signal of the acceleration sensor and to use the main feature or the respective main feature to ascertain the presence of the yaw movement of the head by taking into consideration the at least one prescribed criterion. Therefore, the hearing device has all the advantages and features that arise from the above-described method features in equal measure.

In a preferred refinement, the processor is at least substantially formed by a microcontroller having a microprocessor and a data memory in which the functionality for performing the method according to the invention is implemented by programming in the form of operating software (Firmware), which means that the method is performed automatically—possibly in interaction with the hearing device wearer—when the operating software is executed. The processor can alternatively be implemented by a non-programmable electronic assembly, e.g. an ASIC, in which the functionality for performing the method according to the invention is implemented using circuitry.

The conjunction "and/or" is intended to be understood in this case and below in particular in such a way that the features linked through the use of this conjunction can be formed either together or as alternatives to one another.

Other features which are considered as characteristic for the invention are set forth in the appended claims.

Although the invention is illustrated and described herein as embodied in a method for operating a hearing device and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
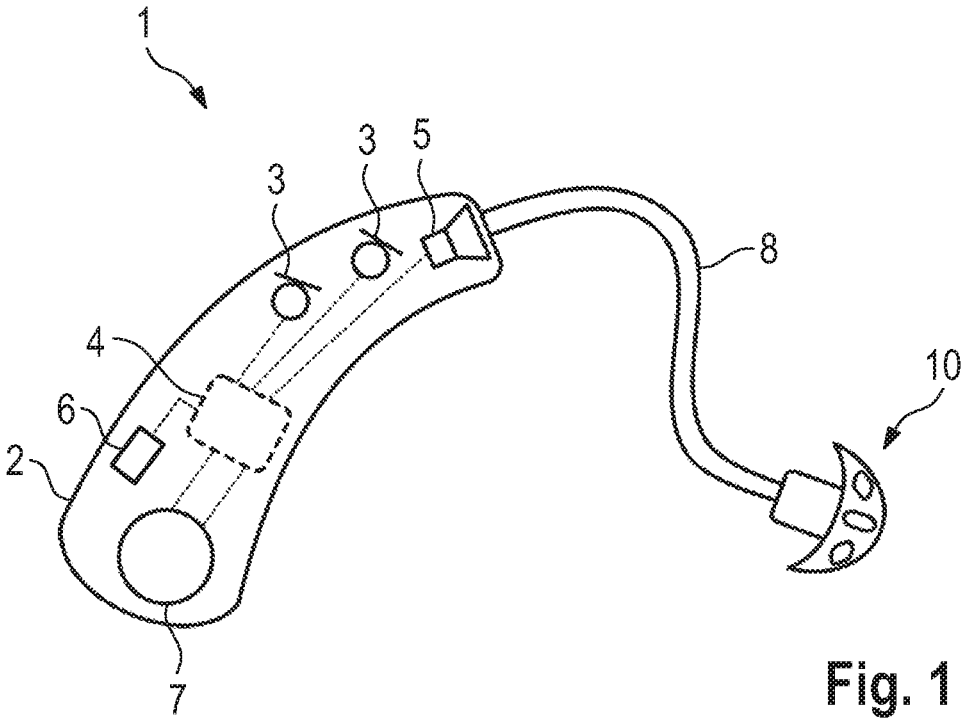
FIG. 1 is a diagrammatic, longitudinal-sectional view of a hearing device with a schematic circuit diagram.

Referring now in detail to the figures of the drawings, in which mutually corresponding parts and variables are always provided with the same reference signs, and first, particularly, to FIG. 1 thereof, there is seen a hearing device 1, specifically a so-called behind-the-ear hearing device. The hearing device 1 includes a (hearing device) housing 2 in which multiple electronic components are disposed. The hearing device 1 includes two microphones 3 as electronic components configured for detecting sounds from the surroundings of the hearing device 1. In addition, the hearing device 1 includes a signal processor 4 as an electronic component. The signal processor is configured to process the sounds captured through the use of the microphones 3 and to output them to a loudspeaker 5 for output to the ear of a hearing device wearer. In order to detect the physical position of the hearing device 1, the latter additionally includes an acceleration sensor 6 interconnected with the signal processor 4. There is additionally a battery 7 disposed in the housing 2 for the purpose of supplying power to these electronic components. The battery is specifically formed by a storage battery in the present exemplary embodiment. In order to conduct the sound produced by the loudspeaker 5 to the ear of the hearing device wearer, the housing 2 has a sound tube 8 connected to it that, in the intended worn state on the head 9, specifically on the ear of the hearing device wearer (see FIG. 2), is inserted into the auditory canal of the hearing device wearer with an ear mold 10.

Figure 2:
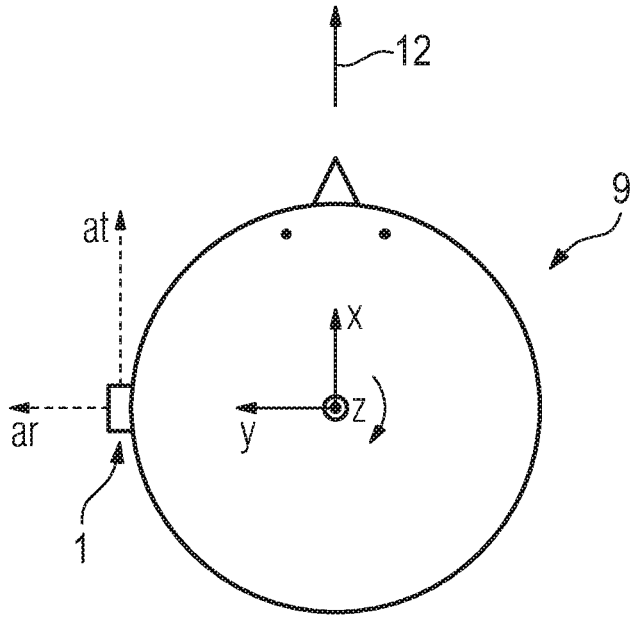
FIG. 2 is a top-plan view of a head of a hearing device wearer with the hearing device worn on the ear as intended.

The acceleration sensor 6 is configured for three-dimensional measurement and, to this end, has three mutually orthogonal measurement axes x, y and z (see FIG. 2). In this case, the acceleration sensor 6 is disposed in the housing 2 of the hearing device 1 in such a way that the measurement axis z coincides with the vertical direction in the intended worn state on the head 9 and when the body posture of the hearing device wearer is upright. The measurement axis x is oriented tangentially in relation to the head 9 and forward—i.e. along a zero degree line of vision 12—in this case. The measurement axis y is directed radially away from the head 9. The two measurement axes x and y are also in a horizontal plane when the body posture of the hearing device wearer is upright. On the basis of this configuration, the measured values associated with the measurement axis x reproduce an acceleration directed tangentially in relation to the head 9 (subsequently referred to as "tangential acceleration at"). The measured values associated with the measurement axis y accordingly reproduce an acceleration directed radially in relation to the head 9 (subsequently referred to as "radial acceleration ar").

The signal processor 4 is configured to use an acoustic classifier, implemented in the signal processor 4 as an algorithm, to infer a conversation situation (i.e. a conversation by at least two people) from the sounds captured through the use of the microphones 3 and then to customize the signal processing accordingly. By way of example, this involves an apex angle of a directional microphone formed through the use of the two microphones 3 being set in such a way that all voice components arriving at the microphones 3 from the surroundings, specifically the source locations of these voice components, lie within the apex area of the directional microphone. In order to be able to customize the signal processing even more precisely in such a conversation situation, specifically in order to be able to adjust the apex angle in such a way that only the people actually involved in the conversation (who each are a source location of a voice component) are within the apex area of the directional microphone, the signal processor 4 performs a method that is explained in more detail below.

In a first method step 20, the measured values ascertained by the acceleration sensor 6—which are output in groups of in each case three measurement values, each of which is in turn associated with one of the measurement axes x, y and z—are stored in a buffer store (which is integrated in the signal processor 4). The buffer store is in this case configured for moving buffer-storage of eight such measured value groups. In a subsequent method step 30, multiple features are derived (also: "extracted") from the measured values associated with the respective measurement axes x, y and z. These features are supplied, in a further method step 40, to a classifier in which a classification algorithm—in the form of a Gaussian mixture mode model in the present exemplary embodiment—is implemented. This classifier uses the features derived in method step 30 to ascertain whether the hearing device wearer turns his or her head 9, i.e. rotates it at least approximately about the measurement axis z. Such "sideways rotation" of the head 9 is referred to hereinbelow as a "yaw movement."

In the configuration and orientation depicted for the acceleration sensor 6 in the present exemplary embodiment, the measurement axis z is thus a so-called yaw axis. Accordingly, the measurement axis x is a roll axis about which the hearing device wearer inclines his or her head 9 to the side, and the measurement axis y is a nod axis about which the hearing device wearer inclines his or her head 9 downward or upward ("nodding"; analogous to the terms "yaw", "roll" and "pitch").

In parallel with method steps 30 and 40 described above, a method step 50 involves the measured values of the acceleration sensor 6 that are stored in the buffer store being purged of steady-state and, in comparison with the duration of a head movement, only slowly changing influences. The influence of the gravitational pull, which can be assumed to be in a steady-state, is removed through the use of a high pass filter in this case. Further influences leading to an offset in the measured values, for example an anatomically dependent deviation in the actual yaw axis from the vertical and/or the actual orientation of the measurement axis z, are removed, in one exemplary embodiment, by subtracting the temporal average of the buffer measured values from the respective "single measured value." Influences with a linear effect (i.e. linear trends) are removed by so-called "detrending."

If a method step 55 involves the classifier outputting the result that there is a yaw movement of the head 9, a further method step 60 involves a value of a yaw angle W being determined from the ascertained measured values, specifically from the tangential acceleration at. That is to say that the amount by which the hearing device wearer has turned his or her head 9 is ascertained (see FIG. 8).

The information regarding whether there is a yaw movement and through what yaw angle W the head 9 is turned is used in a method step 70 to perform a statistical analysis. This involves ascertaining how often the hearing device wearer turns his or her head 9 within a prescribed time window. Additionally, the values of the yaw angle W that are associated with the individual yaw movements are used to create a histogram, from which it is possible to read the directions—referenced to the zero degree line of vision 12—in which the hearing device wearer has turned his or her head 9 in the prescribed time window (see FIG. 9). The frequency distribution of the individual directions can also be used to read a spatial distribution of the area of interest of the hearing device wearer from this histogram.

In a further method step 80, the information generated in method steps 60 and 70 is used by the signal processor 4 to additionally customize the signal processing. Specifically, this method step 80 involves the information of the acoustic classifier described above and of the "movement analysis" described above being fused through the use of the acceleration sensor 6 so as to allow more precise customization of the signal processing to a conversation situation. In one exemplary embodiment, specifically the apex angle of the directional microphone, the orientation of the directional cone of the directional microphone and the position of a so-called "notch" are customized further, if need be delimited further in comparison with a setting proposed solely by the acoustic classifier, on the basis of the information—namely of the yaw angle W and of the histogram—ascertained through the use of the acceleration sensor 6.

Figure 4:
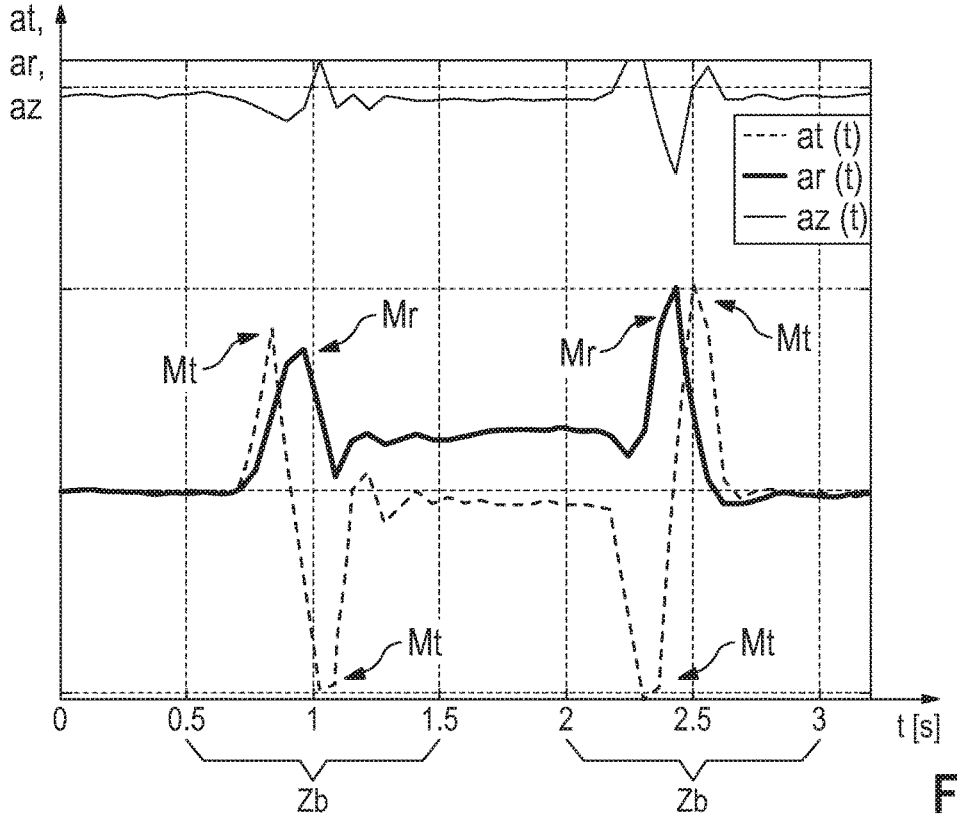
FIGS. 4 and 5 each show a graph for features derived from an acceleration signal plotted against time.

In a first exemplary embodiment, method step 30 involves one main feature ascertained being a time characteristic at(t) of the tangential acceleration at. The supplementary feature ascertained is a time characteristic ar(t) of the radial acceleration ar. In method step 40, one criterion considered for the presence of the yaw movement is whether the time characteristic at(t) of the tangential acceleration at assumes two local extremes Mt having opposite arithmetic signs, which indicate two opposite accelerations, namely an actual acceleration and a slowing-down, within a prescribed time period, subsequently referred to as "movement time window Zb," having a duration of one second. In addition, the criterion also involves consideration of whether the time characteristic ar(t) of the radial acceleration ar assumes a local extreme Mr, indicating a head movement with an acceleration component directed radially in relation to the head 9, within the movement time window Zb. FIG. 4 depicts, in exemplary fashion, the time characteristics at(t) and ar(t) for a yaw movement of the head 9 to the right (see seconds 0.5-1.5) and to the left (see seconds 2-3), in each case. For the yaw movement to the right, the time characteristic at(t) therefore—due to the orientation of the measurement axis x forward—initially passes through the "positive" extreme Mt, which indicates the beginning of the yaw movement, and subsequently passes through the "negative" extreme Mt, which indicates the slowing-down of the head 9 at the end of the yaw movement. In parallel, the time characteristic ar(t)—due to the orientation of the measurement axis y to the outside—likewise shows a positive extreme Mr within the movement time window Zb due to the centrifugal force. The response is accordingly converse for the yaw movement to the left, as can be taken from the right-hand half of FIG. 4. If such a manifestation of the main feature and of the supplementary feature—i.e. as depicted between seconds 0.5 and 1.5 or 2 and 3—is detected in method step 40, the classifier outputs, in method step 55, that there is a yaw movement. Without the extreme Mr in the time characteristic ar(t), that is to say without an actually present radial acceleration ar, there is, for example, only a movement of the head 9 or of the hearing device wearer directed straightforward.

Figure 5:
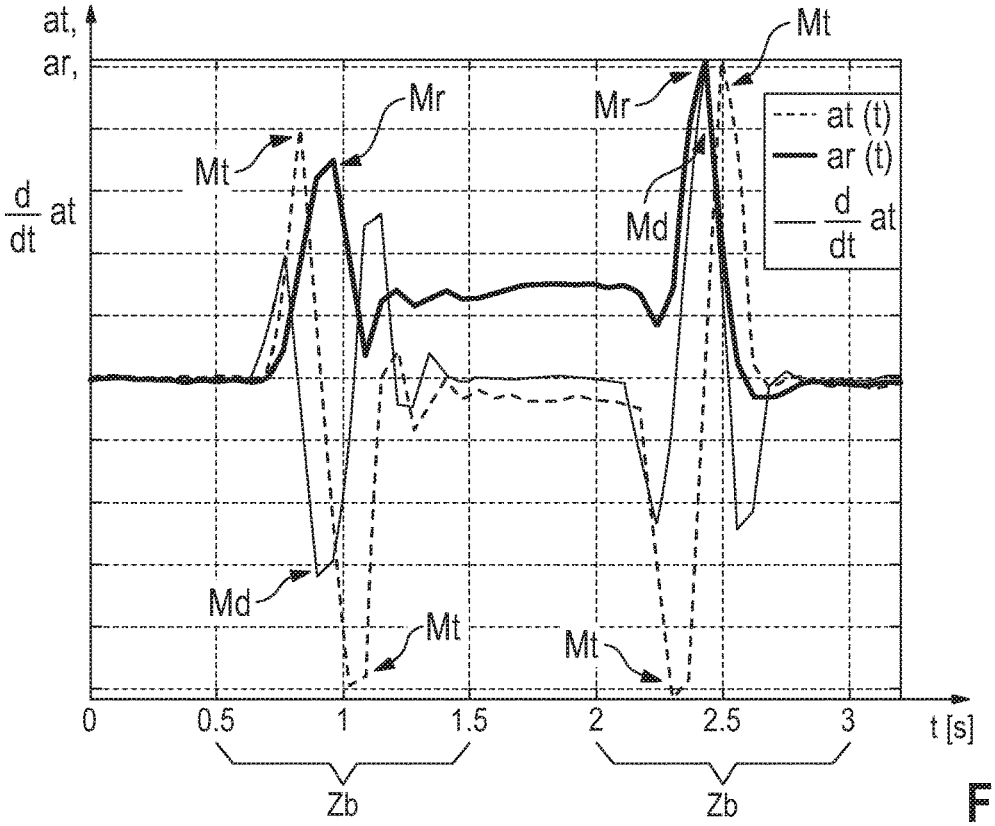

In a further exemplary embodiment, method step 30 involves the main feature determined being a correlation coefficient K between a time derivative of the tangential acceleration at, specifically the time characteristic at(t) thereof, and the radial acceleration ar, specifically the time characteristic ar(t) thereof. This is depicted in more detail in FIG. 5. The timing of the change in the tangential acceleration at, specifically a temporal extreme Md in this change, which can be seen from the time derivative of the tangential acceleration at, coincides—as can be seen from FIG. 5—for a yaw movement of the head 9 at least approximately with that of the extreme Mr in the radial acceleration ar. Therefore, the value of the correlation coefficient K—specifically the level of the absolute value thereof—reveals whether there is a yaw movement at all. It is additionally possible to read the direction of the yaw movement from the arithmetic sign of the correlation coefficient K. For the yaw movement to the right depicted between seconds 0.5-1.5 in FIG. 5, the value of the correlation coefficient K is approximately −0.75. For the yaw movement to the left depicted between seconds 2-3, the correlation coefficient K is approximately 0.8.

Figure 6:
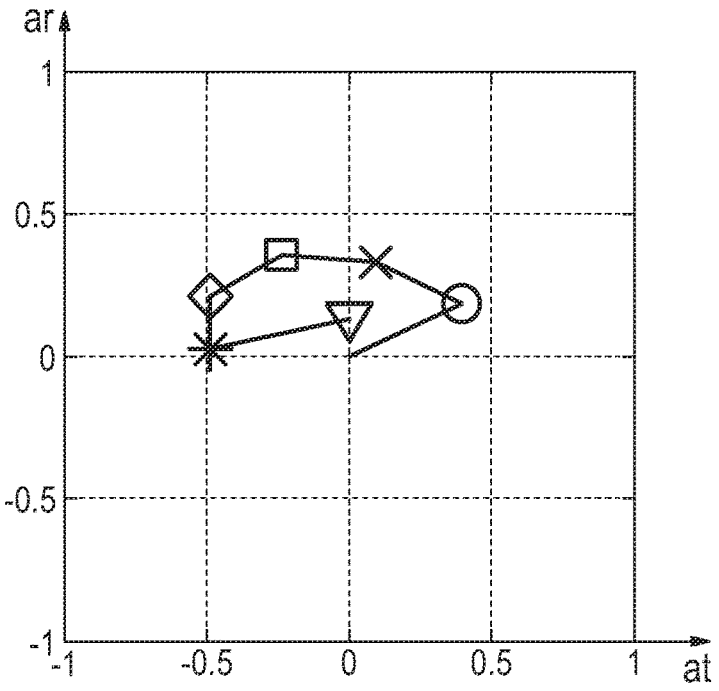
FIGS. 6 and 7 each show a graph in which a radial acceleration is plotted against a tangential acceleration, for a characteristic of the acceleration.
Figure 7:
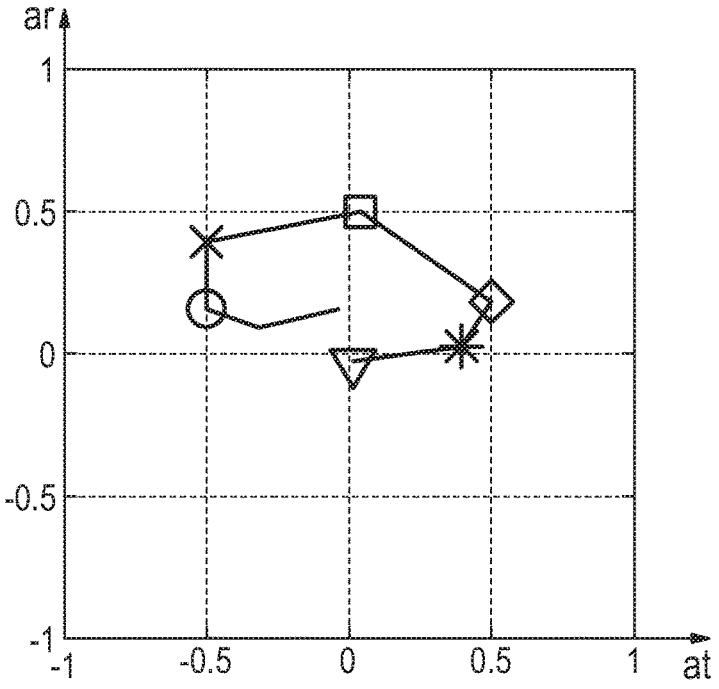

In a further exemplary embodiment, explained on the basis of FIGS. 6 and 7, method step 30 involves the main feature produced being a curve D of a graph in which the radial acceleration ar is plotted against the tangential acceleration at. In the subsequent method step 40, the criterion used is the shape of this curve D. Specifically, consideration is given to whether the curve D can be approximated to the shape of an ellipse. In this case, the measured values for the yaw movement to the right are plotted in FIG. 6 and to the left are plotted in FIG. 7, with the measured values also forming the basis for the preceding FIGS. 4 and 5. The depicted offset between the respective start and end (the latter marked by an upside-down triangle) is caused by a crooked head posture in this case. As a result, the shape of the curve D also differs from the ideal circular shape and instead corresponds to an oval or an ellipse. If the curve D has such a shape, the classifier infers the presence of the yaw movement in method step 40 and outputs a corresponding result in method step 55.

In yet a further exemplary embodiment (not depicted in more detail), method step 30 involves the main feature ascertained being a movement intensity I. This is portrayed in this case by the energy contained in the tangential and the radial acceleration. The movement intensity I in this case is estimated on the basis of the averaged vector normals of the respective vector of the tangential and radial acceleration at and ar. By way of example, the energy is estimated in this case through the use of a temporally discrete sum of the vector length of the resulting vector of the tangential and radial acceleration at and ar.

Figure 8:
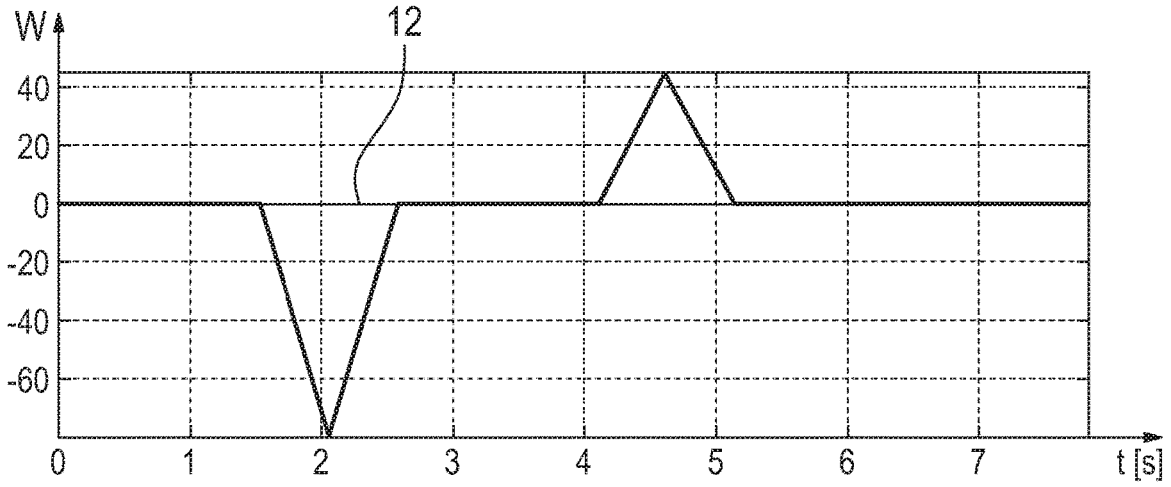
FIG. 8 is a graph for the time characteristic of a yaw angle of the head of the hearing device wearer.

FIG. 8 depicts the time characteristic of the values of the yaw angle W ascertained in method step 60 in exemplary fashion.

Figure 9:
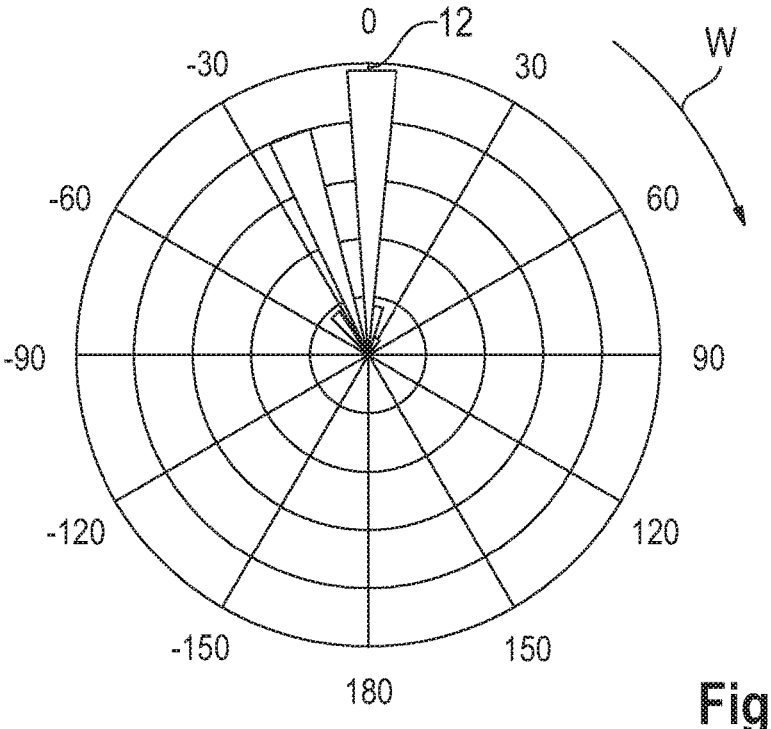
FIG. 9 is a polar diagram for a histogram of the yaw angle.

FIG. 9 depicts the histogram ascertained in method step 70 in the form of a polar diagram in exemplary fashion. From the polar diagram, it is specifically possible to use the radial length of the shaded areas to read how often or for how long the hearing device wearer has turned his or her head 9 in a specific angle range. From this, it is in turn possible to derive a spatial area of interest, which is used in method step 80 to set the apex angle of the directional microphone accordingly. In this specific example, there is a conversation between the hearing device wearer and two people, one directly opposite and one offset to the left by approximately 20-25 degrees.

Figure 3:
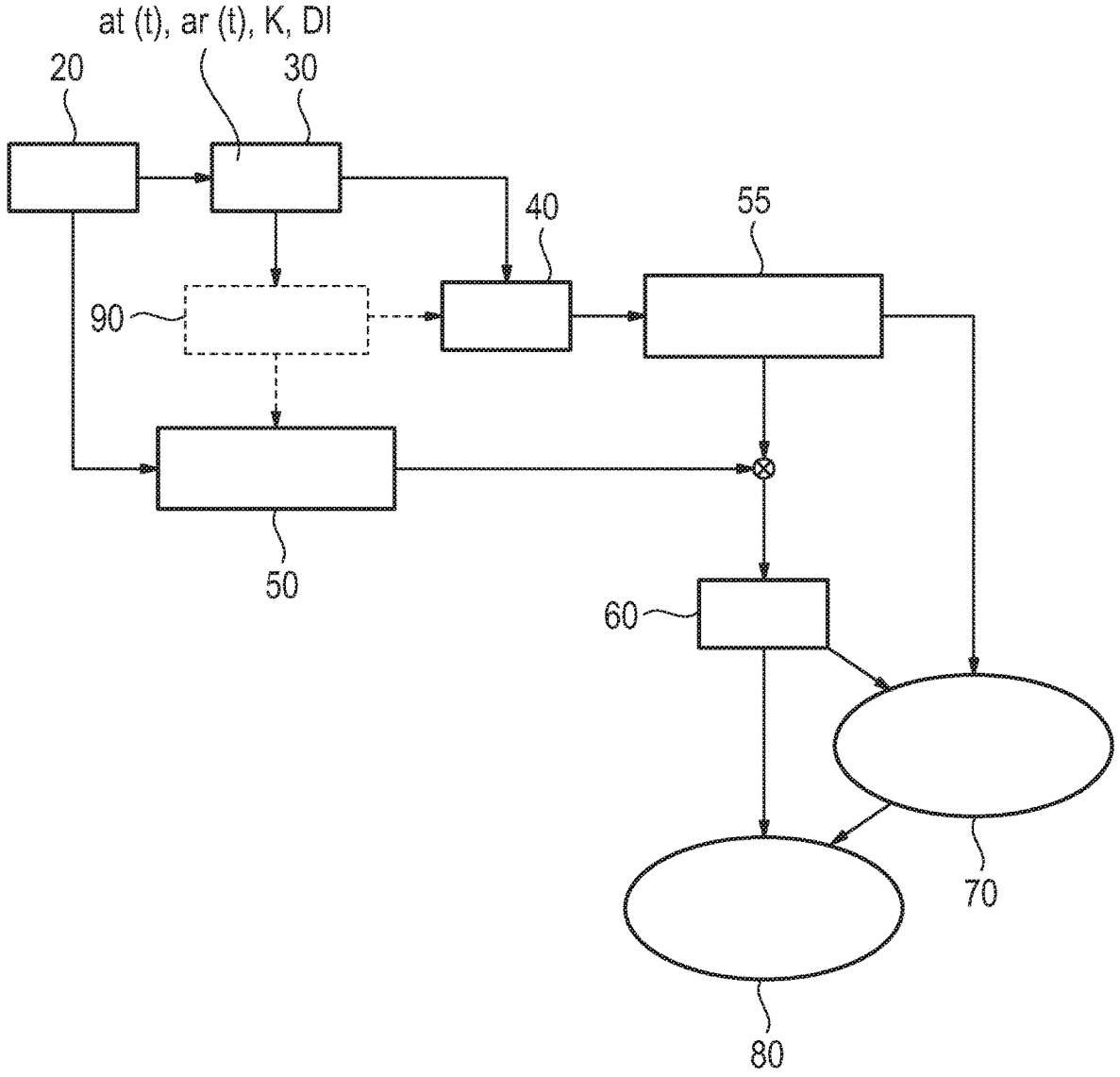
FIG. 3 is a flow chart for a method for operating the hearing device that is performed by a processor of the hearing device.

In an optional exemplary embodiment, a method step 90 (see dashed depiction in FIG. 3) involves a so-called movement classifier being used to infer a movement situation of the hearing device wearer, i.e. a movement state of the entire body or an activity including the movement state, from the features ascertained in method step 30. By way of example, method step 90 involves ascertaining whether the hearing device wearer is at rest or for example is riding a bicycle. If the hearing device wearer is at rest, the probability of the hearing device wearer taking part in a conversation with multiple third persons is also higher. If he or she is riding a bicycle, the probability of him or her taking part in such a conversation is comparatively low. In that case, the ascertainment of the yaw movement in method step 40 and the subsequent method steps 60-80 optionally do not take place.

In a further optional exemplary embodiment, method step 55 involves the classifier also outputting the (temporal) duration of the yaw movement and optionally also the level of the yaw movement, specifically the movement intensity I.

In a further exemplary embodiment, not depicted in more detail, a further method step involves a "reset" being performed, i.e. referencing of the zero degree line of vision 12, whenever an almost pure nodding movement takes place, which is indicative of drinking, for example. As a result, the histogram can be produced particularly precisely and robustly, since—even in the case of undetected yaw movements—the zero degree line of vision 12 can be repeatedly "found" and this prevents the individual values of the yaw angle W from adding up and thus the incorrect assumption that the zero degree line of vision 12 is changing.

The subject matter of the invention is not restricted to the exemplary embodiments described above. Rather, further embodiments of the invention can be derived from the description above by a person skilled in the art. In particular, the individual features of the invention described on the basis of the different exemplary embodiments, and the refinement variants of those individual features, can also be combined with one another in another way. By way of example, in a further exemplary embodiment, method step 40 involves all of the features described above, specifically the main features and the supplementary feature, being checked for whether they satisfy the respective criterion.

The following is a summary list of reference numerals and the corresponding structure used in the above description of the invention.

LIST OF REFERENCE SIGNS

1 Hearing device
2 Housing
3 Microphone
4 Signal processor
5 Loudspeaker
6 Acceleration sensor
7 Battery
8 Sound tube
9 Head
10 Ear mold
12 Zero degree line of vision
20 Method step
30 Method step
40 Method step
50 Method step
55 Method step
60 Method step
70 Method step
80 Method step
at Tangential acceleration
ar Radial acceleration
at(t) Time characteristic
ar(t) Time characteristic
K Correlation coefficient
D Curve
I Movement intensity
Mt, Mr, Md Extreme
W Yaw angle
Zb Movement time window
x, y, z Measurement axis

The invention claimed is:

1. A method for operating a hearing device, the method comprising the following steps:

providing a hearing device having an acceleration sensor to be positioned on the head of a hearing device wearer in an intended worn state and being configured for measurement in two mutually orthogonal measurement axes;

deriving at least one main feature related to an acceleration directed tangentially in relation to the head from an acceleration signal of the acceleration sensor; and using the at least one main feature to ascertain a presence of a yaw movement of the head by taking into consideration at least one prescribed criterion, beyond a presence of an acceleration value of the tangentially directed acceleration, being indicative of a movement derivable from the acceleration signal itself;

the at least one main feature is at least one of:

a time characteristic of the tangentially directed acceleration, or a correlation coefficient between a time derivative of the tangentially directed acceleration and a radially directed acceleration, or a curve of a graph in which the tangential acceleration is plotted against a radial acceleration; and the prescribed criterion being used is at least one of:

whether the time characteristic of the tangentially directed acceleration has two oppositely directed local extremes in succession within a prescribed movement time window, or a level of the correlation coefficient, or a geometric shape of the curve.

2. The method according to claim 1, wherein:

one supplementary feature derived from the acceleration signal is a time characteristic of an acceleration directed radially in relation to the head; and the prescribed criterion being used is whether the time characteristic of the radially directed acceleration assumes a local extreme within the prescribed movement time window.

3. The method according to claim 1, wherein:

the at least one main feature ascertained by using the time characteristic of the tangentially and optionally a radially directed acceleration is a movement intensity; and the prescribed criterion being used is a level of the movement intensity.

4. The method according to claim 3, wherein the movement intensity being ascertained is at least one of a movement duration or a total energy or a mean energy contained in the tangentially and radially directed acceleration.

5. The method according to claim 1, which further comprises using the correlation coefficient or an arithmetic sign of the correlation coefficient to ascertain a yaw direction.

6. The method according to claim 1, which further comprises checking the prescribed criterion as to whether the curve of the graph approximates an ellipsoidal shape.

7. The method according to claim 1, which further comprises using a direction of rotation of the curve to ascertain a yaw direction.

8. The method according to claim 1, which further comprises ascertaining the at least one main feature and optionally a supplementary feature in a moving manner over a time window overlapping a subsequent time window.

9. The method according to claim 1, which further comprises ascertaining a value of a yaw angle from the acceleration signal only if the presence of the yaw movement is detected.

10. The method according to claim 1, which further comprises filtering at least one of constant or linear measured value components out of the acceleration signal.

11. The method according to claim 1, which further comprises applying a classification algorithm to the at least one main feature and optionally to a supplementary feature to determine the presence or at least a probability of the presence of the yaw movement.

12. The method according to claim 1, which further comprises ascertaining a spatial area of interest of the hearing device wearer over a prescribed period based on the yaw movement.

13. The method according to claim 1, which further comprises using information about the yaw movement of the head of the hearing device wearer for customizing a signal processing algorithm for a group conversation situation.

14. The method according to claim 1, which further comprises referencing a zero degree line of vision of the hearing device wearer based on at least one of a nodding movement of the head, a vertical movement of the hearing device wearer or a forward movement of the hearing device wearer.

15. The method according to claim 1, which further comprises using an output of a movement classifier as an additional criterion for ascertaining the yaw movement.

16. The method according to claim 1, which further comprises placing the acceleration sensor in or on the hearing device in such a way that one of the measurement axes of the acceleration sensor is at least approximately oriented tangentially relative to the head.

17. A hearing device, comprising:

an acceleration sensor to be positioned on the head of a hearing device wearer in an intended worn state, said acceleration sensor being configured for measurement in two mutually orthogonal measurement axes and for supplying an acceleration signal; and a processor connected to said acceleration sensor and configured to perform the following method steps:

deriving at least one main feature related to an acceleration directed tangentially in relation to the head from the acceleration signal of said acceleration sensor; and using the at least one main feature to ascertain a presence of a yaw movement of the head by taking into consideration at least one prescribed criterion, beyond a presence of an acceleration value of the tangentially directed acceleration, being indicative of a movement derivable from the acceleration signal itself;

the at least one main feature is at least one of:

a time characteristic of the tangentially directed acceleration, or a correlation coefficient between a time derivative of the tangentially directed acceleration and a radially directed acceleration, or a curve of a graph in which the tangential acceleration is plotted against a radial acceleration; and the prescribed criterion being used is at least one of:

whether the time characteristic of the tangentially directed acceleration has two oppositely directed local extremes in succession within a prescribed movement time window, or a level of the correlation coefficient, or a geometric shape of the curve.

* * * * *